US011293335B1

(12) United States Patent
Radavich et al.

(10) Patent No.: US 11,293,335 B1
(45) Date of Patent: Apr. 5, 2022

(54) ACTIVE DRAINING OF ENGINE COOLING SYSTEM

(71) Applicant: Brunswick Corporation, Mettawa, IL (US)

(72) Inventors: Paul M. Radavich, Eldorado, WI (US); Chetan A. Dharmadhikari, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 82 days.

(21) Appl. No.: 16/720,653

(22) Filed: Dec. 19, 2019

(51) Int. Cl.

| | |
|---|---|
| ***F01P 11/02*** | (2006.01) |
| ***F01P 5/12*** | (2006.01) |
| ***F02B 63/06*** | (2006.01) |
| ***F01P 7/14*** | (2006.01) |
| ***F01P 11/04*** | (2006.01) |

(52) U.S. Cl.
CPC ..... *F01P 11/0276* (2013.01); *F01P 5/12* (2013.01); *F01P 7/14* (2013.01); *F01P 11/0285* (2013.01); *F01P 11/04* (2013.01); *F02B 63/06* (2013.01); *F01P 2007/146* (2013.01); *F01P 2023/00* (2013.01); *F01P 2025/04* (2013.01); *F01P 2025/30* (2013.01); *F01P 2025/64* (2013.01); *F01P 2025/70* (2013.01); *F01P 2050/02* (2013.01)

(58) Field of Classification Search
CPC ..... F02B 61/045; F01P 3/202; F01P 3/205; F01P 11/0276; F01P 2050/02; F01P 2050/04; F01P 2050/12; F01P 11/20; F01P 2007/146; F01P 2011/065; F01P 2025/04; F01P 5/14; F01P 2025/08; F01P 5/10; B63H 20/28; B63H 20/285
USPC ..... 123/41.14, 41.08, 41.44, 198 C; 417/364
See application file for complete search history.

(56) References Cited

U.S. PATENT DOCUMENTS

| | | | | |
|---|---|---|---|---|
| 2,532,182 | A | 11/1950 | Murphy | |
| 3,137,281 | A * | 6/1964 | Fulker | F01P 11/14 123/41.02 |
| 4,857,023 | A * | 8/1989 | Takashima | F01P 5/12 440/88 R |
| 5,334,063 | A | 8/1994 | Inoue et al. | |
| 5,579,727 | A * | 12/1996 | Logan | F01P 11/0276 123/41.14 |
| 5,628,285 | A | 5/1997 | Logan et al. | |
| 6,050,867 | A | 4/2000 | Shields et al. | |
| 6,135,064 | A | 10/2000 | Logan et al. | |
| 6,338,309 | B1 | 1/2002 | Michelson | |
| 6,343,965 | B1 | 2/2002 | Biggs et al. | |
| 6,379,201 | B1 | 4/2002 | Biggs et al. | |

(Continued)

*Primary Examiner* — George C Jin
*Assistant Examiner* — Teuta B Holbrook
(74) *Attorney, Agent, or Firm* — Andrus Intellectual Property Law, LLP

(57) ABSTRACT

A cooling system for a marine inboard internal combustion engine includes at least one engine cooling passage disposed in thermal communication with heat emitting portions of the engine. A pump is in fluid communication with the at least one engine cooling passage. The pump draws cooling water out of the at least one engine cooling passage. At least one outlet drain is downstream of the pump for discharging the cooling water that was pumped out of the at least one cooling passage. A switch activates the pump in response to the following: an operator command to stop the engine and/or a speed of the engine being below a threshold speed.

18 Claims, 4 Drawing Sheets

(56) References Cited

U.S. PATENT DOCUMENTS

| | | | | |
|---|---|---|---|---|
| 6,506,085 | B1 | 1/2003 | Casey et al. | |
| 7,089,955 | B1 * | 8/2006 | Komro, Sr. | B60R 15/00 137/301 |
| 7,329,162 | B1 | 2/2008 | Caldwell et al. | |
| 7,438,613 | B2 | 10/2008 | Hubbs | |
| 7,513,812 | B1 * | 4/2009 | Hochmayr | B63B 21/14 123/192.2 |
| 7,585,196 | B1 | 9/2009 | Jaeger | |
| 9,527,567 | B1 | 12/2016 | Loftin et al. | |
| 2003/0104333 | A1 * | 6/2003 | Sendzik | F28D 20/0034 432/122 |
| 2003/0121253 | A1 * | 7/2003 | Ford | F01N 3/005 60/310 |
| 2012/0318213 | A1 * | 12/2012 | Kobayashi | F01P 7/081 123/41.02 |
| 2020/0244197 | A1 * | 7/2020 | Ooba | H02M 7/53871 |

* cited by examiner

ACTIVE DRAINING OF ENGINE COOLING SYSTEM

FIELD

The present description relates to cooling systems for marine inboard internal combustion engines, and more specifically to systems and methods for draining cooling water from such cooling systems.

BACKGROUND

The following U.S. Patents are incorporated herein by reference, in entirety:

U.S. Pat. No. 5,628,285 discloses a drain valve assembly for automatically draining water from a cooling system of an inboard marine engine when the ambient temperature drops to a preselected value. The drain valve includes a cup-shaped base having a group of inlets connected to portions of a cooling system of the engine to be drained, and the open end of the base is enclosed by a cover. Each inlet defines a valve seat and a sealing piston is mounted for movement in the base and includes a series of valve members that are adapted to engage the valve seats. An outlet is provided in the sidewall of the cup-shaped base. The valve members on the sealing piston are biased to a closed position by a coil spring and a temperature responsive element interconnects the sealing piston with the cover. The temperature responsive element is characterized by the ability to exert a force in excess of the spring force of the coil spring when the ambient temperature is above about 50° F., to thereby maintain the valve members in the closed position. When the temperature falls below the selected temperature, the temperature responsive element will retract, thereby permitting the valve members to be opened under the influence of the spring to automatically drain water from the cooling system of the engine.

U.S. Pat. No. 6,135,064 discloses an engine cooling system provided with a manifold that is located below the lowest point of the cooling system of an engine. The manifold is connected to the cooling system of the engine, a water pump, a circulation pump, the exhaust manifolds of the engine, and a drain conduit through which all of the water can be drained from the engine.

U.S. Pat. No. 6,343,965 discloses a drain system for a marine vessel is provided which includes one or more pressure actuated valves associated with the coolant water drain system. The boat operator is provided with a pressure controller that allows pressure to be introduced into the system for the purpose of actuating the drain valves and, as a result, opening various drain conduits to allow cooling water to drain from the engine cooling system into the bilge or overboard.

U.S. Pat. No. 6,379,201 discloses a marine engine cooling system provided with a valve in which a ball moves freely within a cavity formed within the valve. Pressurized water, from a sea pump, causes the ball to block fluid flow through the cavity and forces pumped water to flow through a preferred conduit which may include a heat exchanger. When the sea pump is inoperative, the ball moves downward within the cavity to unblock a drain passage and allow water to drain from the heat generating components of the marine engine.

U.S. Pat. No. 6,506,085 discloses an integral pump and drain apparatus contained in a common housing structure to reduce the required space needed for these components in the vicinity proximate the engine of a marine propulsion system. The valve of the drain is remotely actuated by air pressure and therefore does not require the boat operator to manually remove plugs or manually actuate mechanical components to cause the engine to drain through a drain conduit that is formed as an integral part of the housing structure.

U.S. Pat. No. 7,329,162 discloses a cooling system for a marine vessel that is configured to allow all cooling water to flow out of the cooling circuit naturally and under the influence of gravity when the marine vessel is removed from the body of water. All conduits of the cooling circuit are sloped downwardly and rearwardly from within the marine vessel to an opening through its transom. Traps are avoided so that residual water is not retained within locations of the cooling system after the natural draining process is complete. The opening through the transom of the marine vessel is at or below all conduits of the cooling system in order to facilitate the natural draining of the cooling system under the influence of gravity and without the need for operator intervention.

U.S. Pat. No. 7,585,196 discloses a cooling system for a marine propulsion device that provides a transom opening that is sufficiently low with respect to other components of the marine propulsion device to allow automatic draining of all cooling water from the system when the marine vessel is removed from the body of water in which it had been operating. The engine cooling passages and other conduits and passages of the cooling system are all located at positions above the transom opening. The system provides automatic draining for a marine cooling system that is an open system and which contains no closed cooling portions.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to one example, a cooling system for a marine inboard internal combustion engine includes at least one engine cooling passage disposed in thermal communication with heat emitting portions of the engine. A pump is in fluid communication with the at least one engine cooling passage. The pump is configured to pump cooling water out of the at least one engine cooling passage. At least one outlet drain is downstream of the pump for discharging the cooling water that was pumped out of the at least one cooling passage. A switch is configured to activate the pump in response to at least one of the following: an operator command to stop the engine, and a speed of the engine being below a threshold speed.

According to another example, a system for draining a cooling system of an inboard marine internal combustion engine includes a pump in fluid communication with the cooling system of the engine. The pump is configured to pump cooling water out of the cooling system. At least one outlet drain is downstream of the pump for discharging the cooling water that was pumped out of the cooling system. A switch is configured to activate the pump in response to at least one of the following: an operator command to stop the engine, and a speed of the engine being below a threshold speed.

BRIEF DESCRIPTION OF DRAWINGS

The present disclosure is described with reference to the following Figures. The same numbers are used throughout the Figures to reference like features and like components.

DETAILED DESCRIPTION

Figure 1:
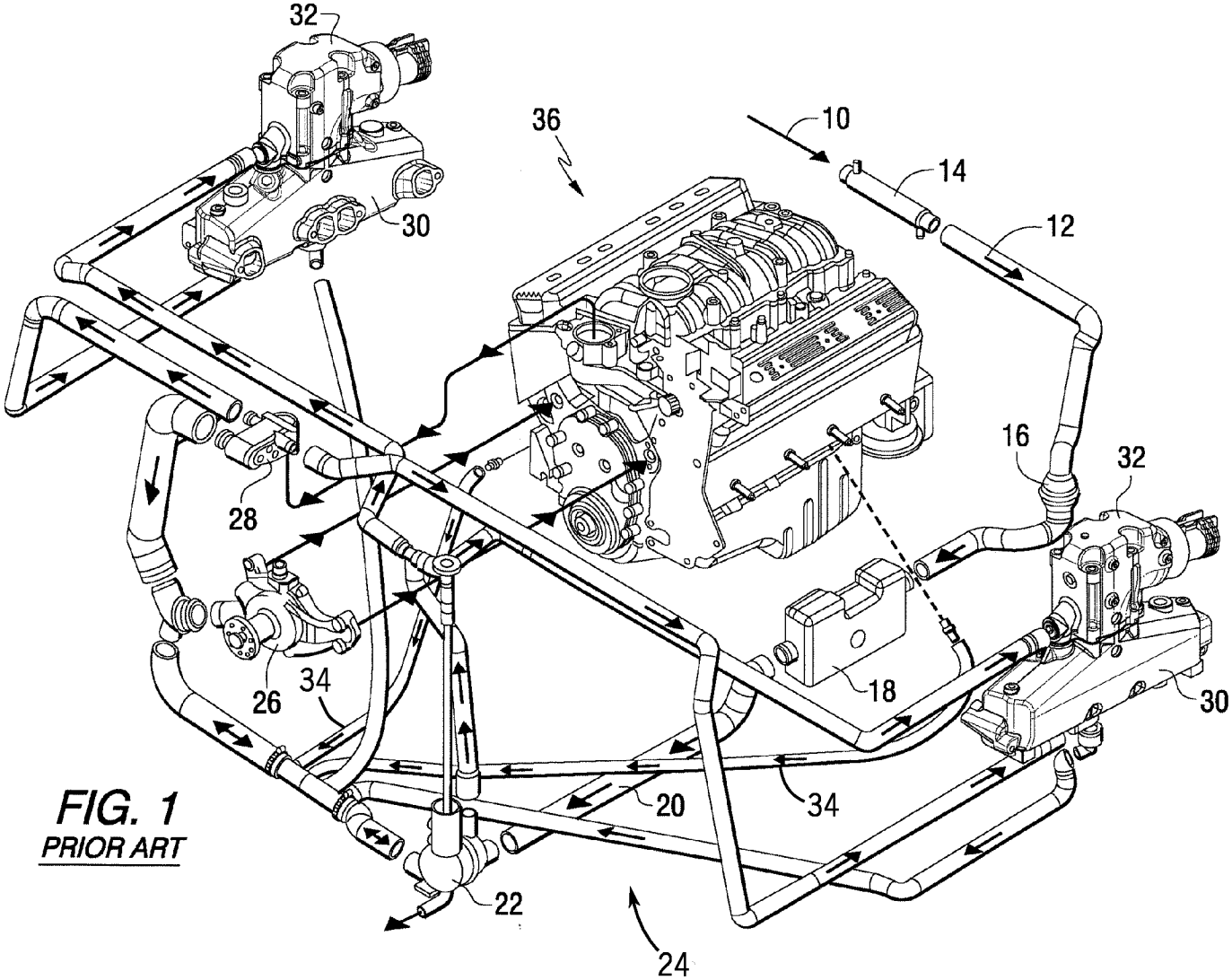
FIG. 1 PRIOR ART
FIG. 1 illustrates a prior art cooling system for a marine inboard internal combustion engine.

FIG. 1 shows a well-known raw-water cooling system 24 used in conjunction with an inboard internal combustion engine 36 for a marine propulsion device. The term "inboard" is used here to indicate that the engine 36 is configured to be located on a marine vessel, forward of the transom, as opposed to an outboard engine. Thus, the engine 36 could be used for an inboard drive (having a propeller and rudder aft of the transom), a stern drive (having a steerable gearcase mounted to the transom), or a pod drive (having a steerable gearcase mounted to the bottom of the vessel). Although the engine 36 shown herein a V-shaped engine, the present disclosure is equally applicable to other engine configurations. Additionally, although a raw-water cooling system 24 is shown and described herein below, the present disclosure is equally applicable to a closed cooling system, which uses raw water in a heat exchanger.

In the cooling system 24, water is drawn from a body of water, as schematically represented by arrow 10, and directed through an inlet conduit 12. If the engine 36 is used for an inboard drive, the water is drawn through the hull by an engine-powered pump. If the engine 36 is used for a stern drive or pod drive, the water is drawn through the drive unit by a pump located therein. In the example shown in FIG. 1, the cooling water is then directed through a power steering cooler 14, a check valve 16, and a fuel cooler 18. The water continues through a conduit 20 to a distribution housing 22. The cooling system 24 is also provided with a water circulating pump 26 and a thermostat housing 28.

With continued reference to FIG. 1, the engine's exhaust system comprises exhaust manifolds 30, which are each associated with an exhaust elbow 32. Some of the cooling water circulating through the conduits in FIG. 1 is injected into the exhaust gas stream flowing through the exhaust components 30, 32 and carried with the exhaust stream through the transom of the marine vessel to be returned to the body of water. Some of the water from the distribution housing 22 is directed to the water circulating pump 26, which pumps the water through cooling passages within the structure of the engine 36, and that cooling water removes heat from heat-emitting components of the engine 36. Warmed water leaving the engine 36 returns to the thermostat housing 28, where it is directed to the exhaust manifolds 30 and/or back to the engine 36 via the water circulating pump 26. In addition, the cooling nature of the water flowing through the conduits in FIG. 1 also removes heat from various other components, such as the power steering cooler 14 and the fuel cooler 18. Although not shown herein, other components can be connected in thermal communication with the cooling water in other applications.

In many inboard drive, stern drive, and pod drive applications, the engine 36 sits below the water line, making it difficult to fully drain the cooling water from the engine 36 by gravity alone. Especially in a raw-water cooling system 24 like that shown in FIG. 1, salt water that sits in the engine 36 can cause corrosion. Thus, many inboard engines have cast iron components, which corrode less readily than aluminum components. However, cast iron is more expensive and heavier than aluminum. The present inventors discovered that if an engine's cooling system 24 could be more effectively drained, such that little or no cooling water pooled on or in metal components, aluminum components could be used to manufacture the engine. Effectively, then, an engine designed for an outboard drive could be reoriented and used as an inboard engine. Specifically, the present inventors determined that a pump could be used to actively draw cooling water out of the engine's cooling system 24 in response to one or more conditions being present, as will be described more fully herein below.

Figure 2:
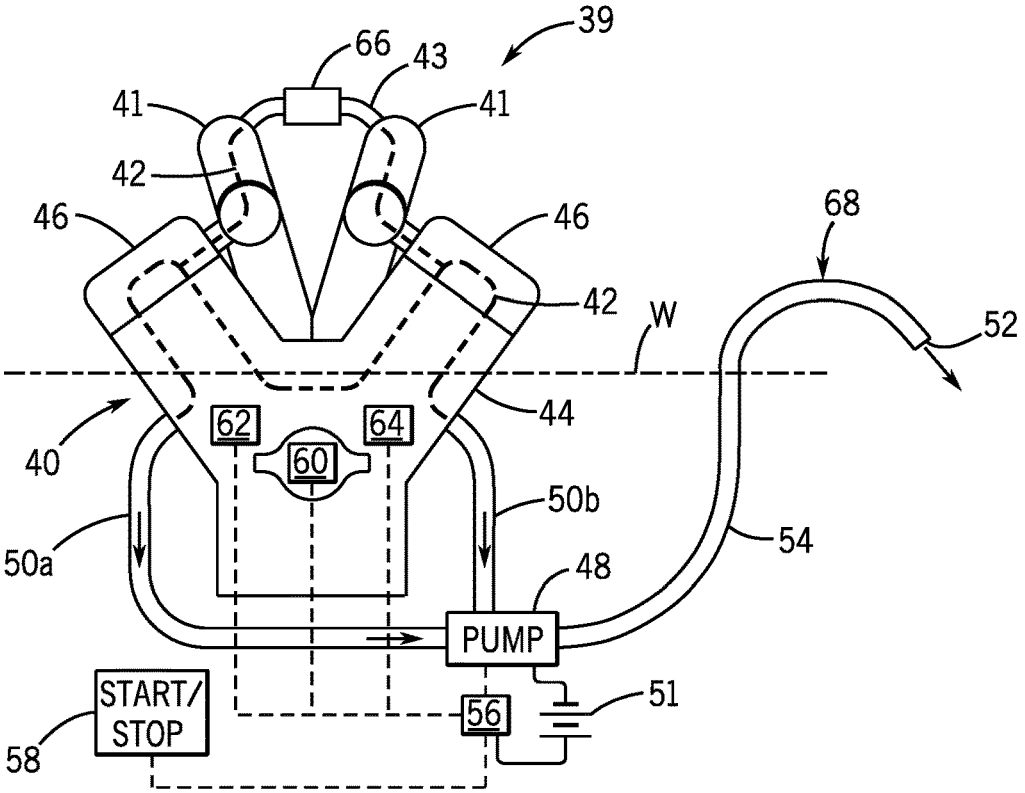
FIG. 2 illustrates a system for draining an engine cooling system according to the present disclosure, wherein the cooling water drains above a waterline and the drain conduit includes an air trap.

FIG. 2 illustrates one example of a cooling system 39 for a marine inboard internal combustion engine 40. The cooling system comprises at least one engine cooling passage 42 disposed in thermal communication with heat emitting portions of the engine 40, such as the cylinder block 44 and cylinder heads 46 shown here. Those having ordinary skill in the art would understand that the engine cooling passages 42 can also be disposed in thermal communication with the intake manifold(s), the exhaust manifolds 41, or other parts of the engine 40 as well, by way of a series of conduits and/or water jackets. A pump 48 is provided in fluid communication with the at least one engine cooling passage 42. The pump 48 can be a positive displacement or a dynamic pump. In some examples, the pump 48 is a centrifugal pump, and more specifically, an impeller pump. The pump 48 is configured to pump cooling water out of the at least one engine cooling passage 42. Here, at least one conduit 50*a*, 50*b* provides fluid communication between the at least one engine cooling passage 42 and the boat-mounted pump 48; however, the conduits 50*a*, 50*b* could be arranged or connected to the engine 40 differently than shown, or the pump 48 could be engine-mounted and directly connected at the location where the at least one engine cooling passage 42 exits the engine 40. In other examples, the pump 48 can be the same pump already provided for pumping water from the bilge area. In one example, the pump 48 is connected to the already-existing conduits (see conduits 34, FIG. 1) in an existing engine cooling system 24, and valves prevent the cooling water from exiting the cooling system 24 when it is not desired to drain the cooling water.

A battery 51 is electrically connected to the pump 48 and configured to power the pump 48. The battery 51 can be connected to the engine's alternator for charging. In examples in which the pump 48 runs after the engine 40 is stopped, the battery 51 can be used to provide power to the pump 48. In other examples in which the pump 48 is run before the engine 40 shuts down, the pump 48 can be configured to be coupled to the engine 40 to power the pump 48. Such a coupling can be made directly by way of a keyed connection to the crankshaft or output shaft, by way of extension shafts connected to the engine's output shaft, or by way of a belt driven by the crankshaft. In some examples, a clutch or other selectively actuatable mechanism is provided to couple and de-couple the pump 48 from the engine 40. Alternatively, even if the pump 48 is run before the engine 40 shuts down, the battery 51 can still be used to power the pump 48.

The pump 48 is connected to the at least one engine cooling passage 42 at a low point of the at least one engine cooling passage 42, here, by the conduits 50*a*, 50*b* being connected to the lowest points of the engine cooling passages 42. In another example, the pump 48 is connected to the at least one engine cooling passage 42 below any corrosive components of the engine 40. The cooling system 39 further includes at least one outlet drain 52 downstream of the pump 48 for discharging the cooling water that was pumped out of the at least one engine cooling passage 42. In the example of FIG. 2, the outlet drain 52 is in fluid communication with the pump 48 by way of a conduit 54. The outlet drain 52 is located above the water level W of water in which the boat is operating, and may be located inside the vessel (such as in the bilge area) or outside the vessel (such as a port through the hull). The conduit 54 and outlet drain 52 can be above the lowest points of the engine cooling passages 42 because of the head provided by the pump 48.

A switch 56 is in electrical and/or signal communication with the pump 48. According to the present disclosure, the switch 56 is configured to activate the pump 48 in response to at least one of the following: an operator command to stop the engine 40, and a speed of the engine 40 being below a threshold speed. In one example, the threshold speed is an idle speed. Either or both of these conditions may be used as a basis for activating the pump 48 to drain the cooling water from the engine 40 as they signify either that the engine 40 is about to stop running, in which case cooling water will no longer be needed, or that the engine 40 likely does not have a need to be cooled, as it is running slowly (e.g., at idle) and not producing much heat.

The operator command to stop the engine 40 may be input via a start/stop input 58 (such as a button, switch, selectable screen icon, or other known input device). The start/stop input 58 is in electrical and/or signal communication with the switch 56, such that operator input to the start/stop input 58 can open or close the switch 56 to turn the pump 48 off or on. For example, if the switch 56 is normally open, an operator command to stop the engine 40, input via the start/stop input 58, will close the switch 56 and turn on the pump 48.

The engine speed may be determined by an engine speed sensor 60, such as a tachometer on the crankshaft or output shaft of the engine 40. In the instance where the engine speed being below a threshold is used as a trigger for the switch 56, a microcontroller or other circuit (see, for example, controller 76, FIG. 6) is also provided in order to compare the engine speed to the predetermined threshold speed. If the engine speed is less than the threshold, the switch 56 (if normally open) is closed to activate the pump 48.

The system 39 further includes a sensor 62 determining a temperature of the cooling water in the at least one engine cooling passage 42. For example, the sensor 62 can be a thermistor. In some examples, the switch 56 is configured to activate the pump 48 in response to the temperature of the cooling water being below a threshold temperature. Again, this embodiment would require a microcontroller or other circuit (see, for example, the controller 76 of FIG. 6) to compare the temperature signal from the sensor 62 with the predetermined temperature. Many engines are already equipped with such a temperature sensor in order to determine if the engine is overheating. Thus, an existing temperature sensor 62 could be electrically connected to the microcontroller or other circuit.

In still other examples, the system may include a sensor 64 determining at least one of a pressure and a level of the cooling water in the at least one engine cooling passage 42. The pressure sensor can be a fluid pressure transducer, while the level sensor can be a float switch, an ultrasonic sensor, or a capacitance sensor. The switch 56 is configured to activate the pump 48 in response to the at least one of the pressure and the level of the cooling water being above a threshold pressure or a threshold level, respectively. Again, this embodiment would require a microcontroller or other circuit to compare the pressure and/or level signal from the sensor 64 with the predetermined pressure and/or level. In some examples, the level or pressure of water in the cooling system 39 being above a threshold is used a secondary criterion for turning on the pump 48, and a primary criterion is that the temperature of the cooling water must first be below a threshold.

In some examples, the system 39 may include a vent 66 in fluid communication with the at least one engine cooling passage 42. Here, the vent 66 is located in the conduit 43 connecting the engine cooling passages 42 in the exhaust manifolds 41. However, the vent could be located elsewhere in the system 39, such as in the cooling water passage for the air inlet manifold. The vent 66 facilitates draining of the engine cooling passages 42 because the pump 48 does not need to draw a vacuum. The vent 66 can be in the form of a one-way or non-return valve in the exhaust cooling passages. Such a valve would automatically open when the pressure on one side overcomes the pressure on the other side, to allow air into the cooling system. In other examples, the valve is an electrically, hydraulically, or pneumatically actuated valve, which is opened in response to the same conditions as those which cause the pump 48 to run, and/or in response to the pump 48 running. In other examples, the vent/valve is located in the inlet cooling water passages (see conduit 12, FIG. 1). In still other examples, the vent is in the form of the cooling water inlet conduit being fluidically connected to the exhaust gas passage.

Still referring to FIG. 2, the system 39 shown therein further comprises an air trap 68 between the pump 48 and the outlet drain 52. The air trap 68 is formed by the conduit 54 extending above the water line W and thus acts as a dam to prevent water from flowing by gravity and re-entering the system 39 in the opposite direction when the pump 48 is not running.

Figure 3:
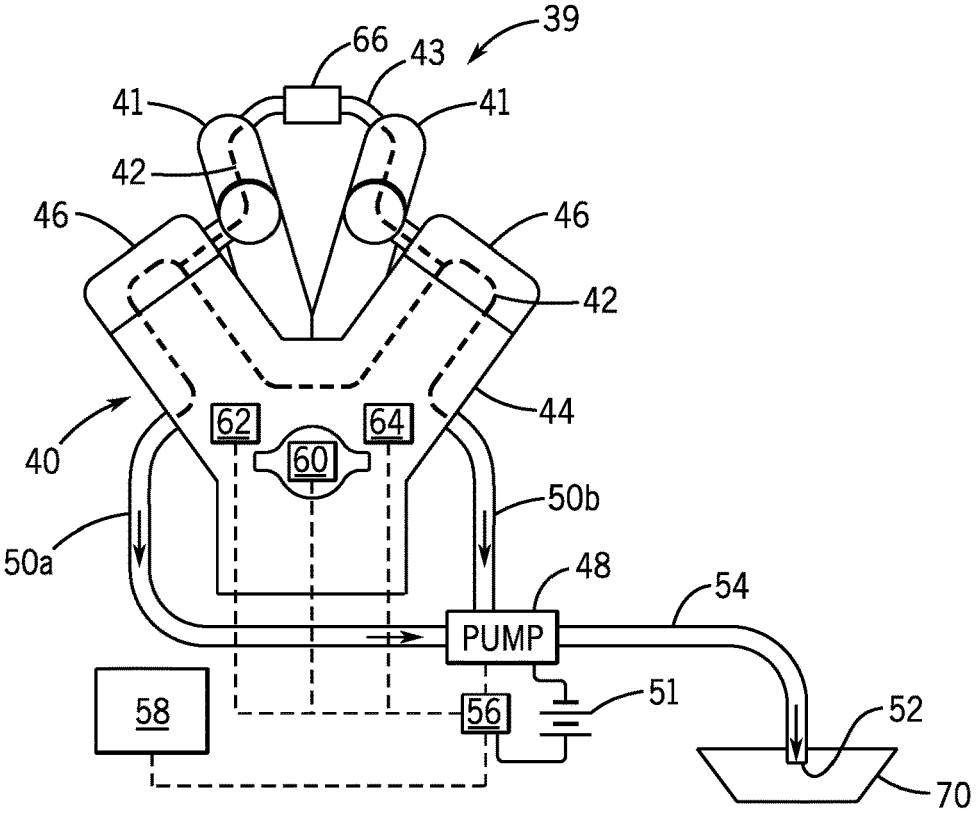
FIG. 3 illustrates a system for draining an engine cooling system according to the present disclosure, wherein the cooling water drains to a bilge area of a marine vessel.

In contrast to the example of FIG. 2, in the example of FIG. 3, no air trap is provided, and the outlet drain 52 is located in the bilge area 70 of the marine vessel. Note that in this example, the bilge pump (not shown) would operate as normal, such that when the water level in the bilge area 70 reaches a certain point, the bilge pump would run and pump water overboard. All other parts of the system in FIG. 3 are identical to those in FIG. 2, other than the exact routing of the drain conduit 54, and thus they will not be described more fully herein for brevity's sake.

Figure 4:
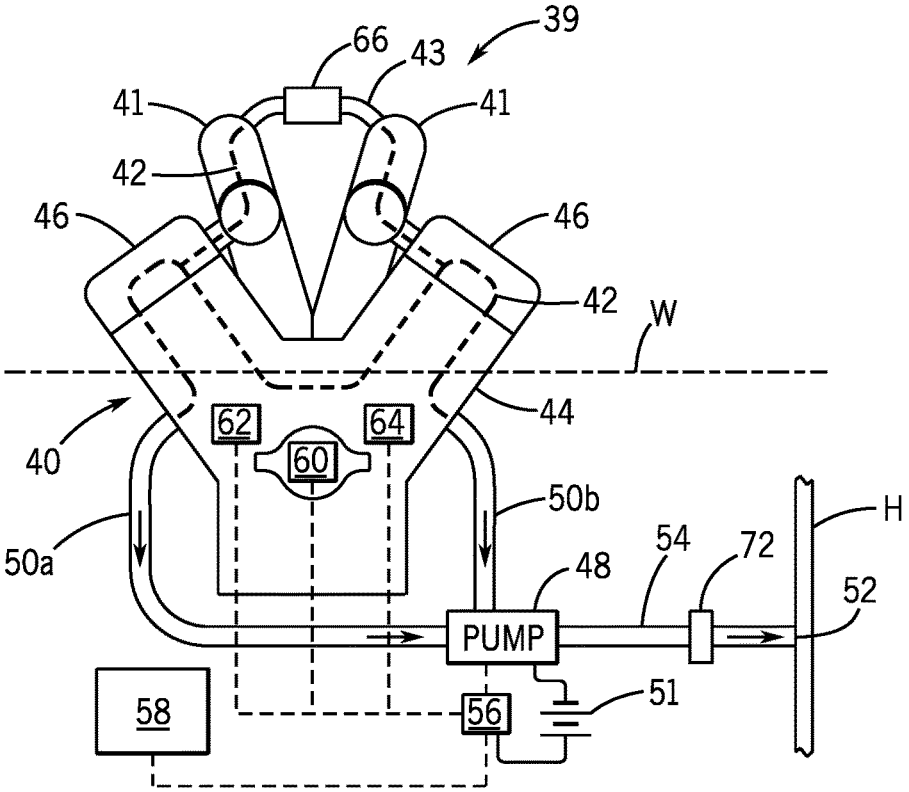
FIG. 4 illustrates a system for draining an engine cooling system according to the present disclosure, wherein the cooling water drains through the hull of a marine vessel and the drain conduit includes a valve preventing water from re-entering the cooling system through the drain conduit.

In the example of FIG. 4, instead of the air trap, a valve 72 is provided in the drain conduit 54 between the pump 48 and the outlet drain 52. The valve 72 can be a one-way or non-return valve that automatically opens when the pressure on one side overcomes the pressure on the other side, to allow water to exit the conduit 54 under pressure from the pump 48, but not to allow water to flow from the outlet drain 52 back toward the pump 48. In other examples, the valve 72 is an electrically, hydraulically, or pneumatically actuated valve, which is opened in response to the same conditions as those which cause the pump 48 to run, and/or in response to the pump 48 running. In a system like that of FIG. 4, the outlet drain 52 can be located through the hull H below the water line W, as the pump 48 can provide the pressure necessary to overcome surrounding water pressure, while the valve 72 prevents back flow of water into the cooling system 39. All other parts of the system in FIG. 4 are identical to those in FIG. 2, and thus they will not be described more fully herein for brevity's sake.

Figure 5:
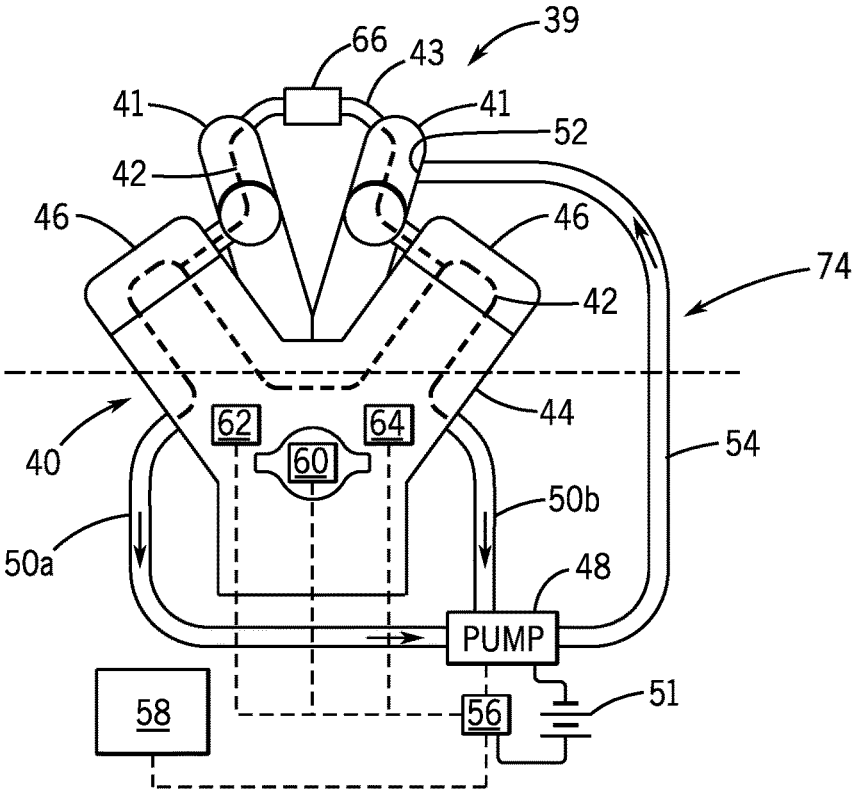
FIG. 5 illustrates a system for draining an engine cooling system according to the present disclosure, wherein the cooling water drains to an exhaust manifold of the engine and the drain conduit includes a riser portion.

In the example of FIG. 5, the system further comprises a riser 74 between the pump 48 and the outlet drain 52. Additionally, in the present example, the outlet drain 52 is located in one of the exhaust manifolds 41. The riser 74 is formed by the drain conduit 54 extending above the cylinder block 44 and cylinder heads 46 and above the water line W such that water cannot re-enter the conduit 54 under the force of gravity. The connection of the outlet drain 52 to the exhaust manifold 41 also provides a vent, which can facilitate draining by preventing the pump 48 from needing to draw a vacuum in the cooling system, as noted herein above. All other parts of the system in FIG. 5 are identical to those in FIG. 2, and thus they will not be described more fully herein for brevity's sake.

Figure 6:
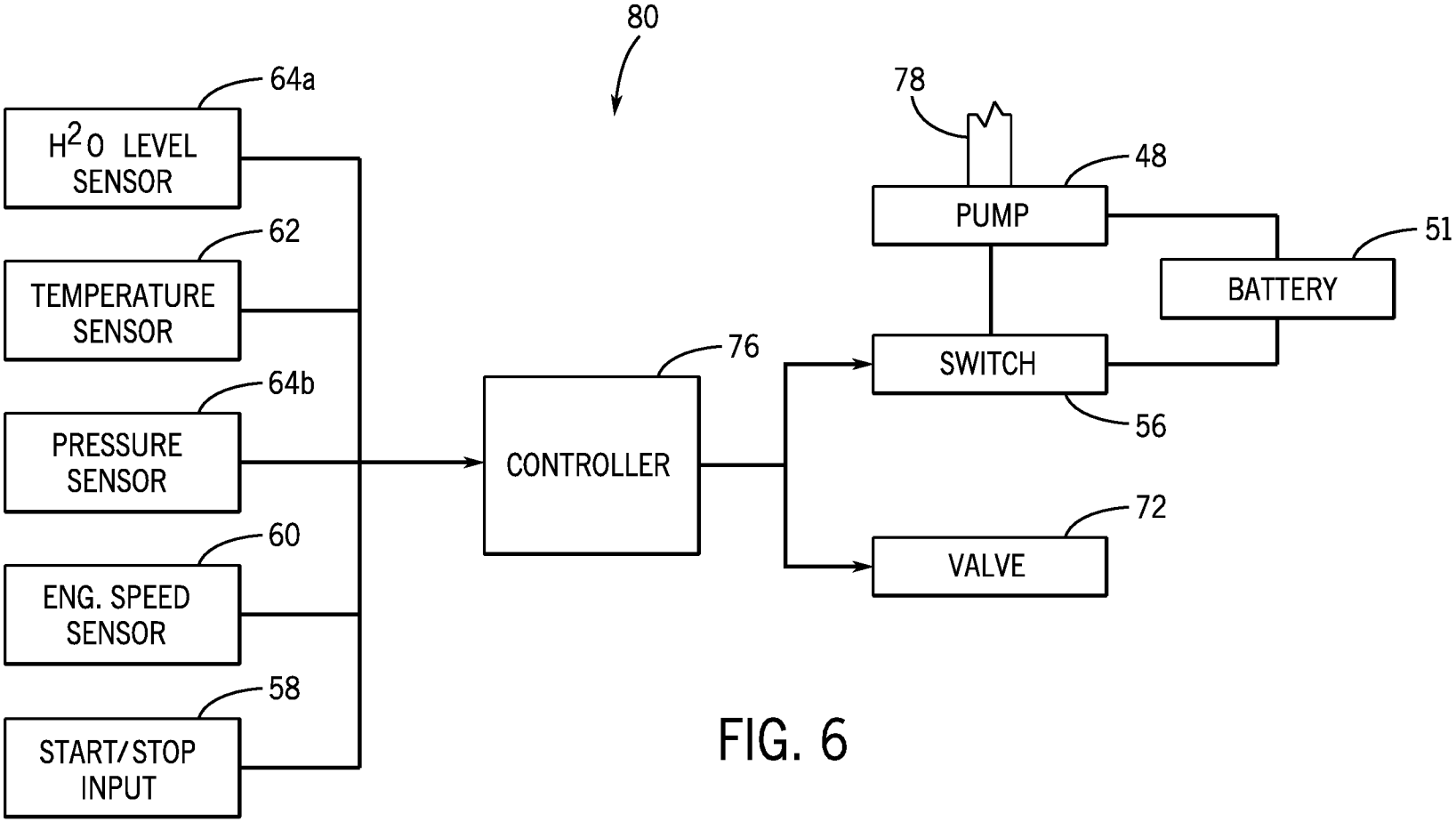
FIG. 6 illustrates a system for draining an engine cooling system according to the present disclosure, including a controller controlling a pump that actively drains the cooling system.

Thus, FIGS. 2-5 illustrate various systems for draining a cooling system 39 of a marine inboard internal combustion engine 40. FIG. 6 will now be referred to for purposes of explaining yet another system for draining a cooling system 39 of a marine inboard internal combustion engine 40, in which a controller 76 is provided in signal communication with the above-noted switch 56 and configured to actuate the switch 56 to activate the pump 48 in response to the at least one of the operator command to stop the engine 40 and the speed of the engine 40 being below the threshold speed. Note that the controller 76 of FIG. 6 could be incorporated with any of the configurations shown in FIGS. 2-5, as will be apparent to those having ordinary skill in the art. Thus, although not every component shown in FIG. 6 needs to be provided in a given system, every component is shown for purposes of illustrating that it can be connected to the controller 76 in alternative embodiments. Note that although the controller 76 is shown herein as a separate component, such as a standalone module, in another example, the controller 76 is located on the pump 48. In other examples, the controller 76 can be the engine control unit.

As shown, the system 80 may include the water level sensor 64*a* sensing a water level in the engine cooling passages 42, the temperature sensor 62 sensing a temperature of the water in the engine cooling passages 42, and the pressure sensor 64*b* sensing the pressure in the engine cooling passages 42, all in electrical/signal communication with the controller 76. The engine speed sensor 60 and the start/stop input 58 are also in electrical/signal communication with the controller 76. The controller 76 receives measurements and/or commands from these input sources, as appropriate, and determines if the pump 48 should be run to drain the cooling system 39. As shown in the examples of FIGS. 2-5, the pump 48 is in fluid communication with the cooling system 39 of the engine 40, and the pump 48 is configured to pump cooling water out of the cooling system 39. Furthermore, at least one outlet drain 52 is provided downstream of the pump 48 for discharging the cooling water that was pumped out of the cooling system 39.

The controller 76 is provided in electrical and/or signal communication with the switch 56, and the switch 56 is configured to activate the pump 48 in response to at least one of the following: an operator command to stop the engine 40, and a speed of the engine 40 being below a threshold speed. More specifically, if the controller 76 receives an indication from the start/stop input that the engine 40 is to be stopped, the controller 76 controls the switch to turn on the pump 48. Alternatively, if the controller 76 receives an indication that the engine speed, as determined by the engine speed sensor 60, is below a predetermined threshold speed, which can be saved in a memory of the controller 76, the controller 76 controls the switch 56 to turn on the pump 48. In yet another example, the controller 76 must determine both that a stop command has been input and that the engine speed is below the threshold before the controller 76 will command the switch 56 to turn on the pump 48.

Note that the switch 56 is shown herein as being a separate element than the controller 76 and the pump 48. However, the switch 56 could instead be located in the controller 76. In another example, the switch 56 is located on the pump 48. The switch 56 can be an electro-mechanical or an electrical switch. In some examples, another switch is provided that allows the operator of the marine vessel to manually activate the pump 48 to drain the cooling system. However the switch 56 is actuated, upon actuation, the pump 48 may be connected to the battery 51 to provide electrical power to the pump 48. The battery 51 can be the main battery for the marine vessel, or can be a separate battery dedicated to the pump 48. As noted herein above, in alternative embodiments, the pump 48 is configured to be coupled to an output shaft 78 of the engine 40 to power the pump 48. The output shaft 78 is shown schematically here, and it should be understood that the coupling to the pump 48 can be made in many different ways, as described herein above.

As noted with respect to the description of FIGS. 2-5, the system further includes at least one of an air trap, a riser, and a valve fluidically connected between the pump 48 and the outlet drain 52. The valve 72 is shown in FIG. 6 as also being connected to the controller 76. The controller 76 may open the valve 72 at the same time that the controller 76 actuates the switch 56 to activate the pump 48, or may wait a predetermined period of time after actuating the switch 56 to allow the pump 48 time to begin drawing water from the cooling system 39. The controller 76 may close the valve 72 at the same time the controller 76 deactivates the pump 48.

In one example, the pump 48 is configured to run for a predetermined period of time after being activated in response to the operator command to stop the engine 40. For example, the controller 76 can include a timer than runs for the predetermined period of time after actuating the switch 56 to run the pump 48 in response to an operator "stop" command from the start/stop input 58. Once the predetermined time has elapsed, the controller 76 may automatically deactivate the pump 48. The predetermined time may be an amount of time that is calibrated to empty the cooling system 39 of water. If the pump 48 is powered by the engine 40, the controller 76 can be configured to keep the engine 40 running to power the pump 48, even after receiving the "stop" command from the start/stop input 58. The controller 76 would then stop the engine 40 and the pump 48 together after the predetermined period of time elapsed.

In another example, the controller 76 is configured to deactivate the pump 48 in response to the pressure sensor 64*b* or level sensor 64*a* sensing that the cooling system 39 has been emptied of water. For example, if the controller 76 determines that the water level has dropped below a predetermined threshold, or that the water pressure has dropped below a predetermined threshold, the controller 76 may deactivate the pump 48. In still other examples, the cooling water temperature as read by the temperature sensor 62 can be used as criterion to control the pump 48. The pump 48 can be run to drain the cooling system 39 so long as the cooling water temperature is below a given threshold; however, the controller 76 will stop the pump 48 if the cooling water temperature exceeds the threshold. If the pump 48 is run using power from the engine 40, similar to the example using a predetermined run-time described above, the controller 76 can be configured to keep the engine 40 running to power the pump 48, even after receiving the "stop" command from the start/stop input 58. Once the conditions for stopping the pump 48 are met, the controller 76 will stop the pump 48 along with the engine 40.

As noted briefly herein above, the pump 48 may additionally or alternatively be activated while the engine 40 is running below a predetermined speed. For example, if the engine 40 is running at idle speed, it may be that the operator is about the stop the engine 40. The controller 76 could therefore run the pump 48 while the engine 40 idles, using power from the battery 51 or the engine 40. The same conditions regarding threshold temperature, water level, and/or pressure could be used to determine when the pump 48 should be started and/or stopped.

The controller 76 may be in signal communication with the input and output devices shown in FIG. 6 by way of a serial communication bus, such as a CAN bus. In alternative configurations, the controller 76 may be in analog electrical communication with one or all of the input or output devices. The controller 76 may include a processor, memory, and code stored in the memory that causes the processor to execute the algorithms described herein above. In some examples, the controller 76 may be an application-specific integrated circuit or a system-on-a-chip. As noted herein above, the controller 76 may alternatively be the engine control module.

While prior art systems drain water from a marine inboard engine's cooling system when the marine vessel is pulled out of the water or when the operator activates the drain manually, the present system and method drain the cooling system every time the engine 40 is shut down. The present system also prevents water from entering the cooling system 39 when the engine 40 is not running, by way of an air trap 68, valve 72, and/or riser 74 in the drain connection. The drain system operates without compromising cooling of the engine 40 while it is running.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A cooling system for a marine inboard internal combustion engine, the cooling system comprising:

at least one engine cooling passage disposed in thermal communication with heat emitting portions of the engine;

a pump in fluid communication with the at least one engine cooling passage, the pump provided downstream of the at least one engine cooling passage and configured to pump cooling water out of the at least one engine cooling passage;

a sensor determining a temperature of the cooling water in the at least one engine cooling passage;

at least one outlet drain downstream of the pump for discharging the cooling water that was pumped out of the at least one engine cooling passage; and a switch configured to activate the pump in response to at least one of the following:

an operator command to stop the engine; and a speed of the engine being below a threshold speed;

wherein the pump is configured to stop pumping cooling water out of the at least one engine cooling passage in response to the temperature of the cooling water exceeding a threshold temperature.

2. The cooling system of claim 1, further comprising a sensor determining at least one of a pressure and a level of the cooling water in the at least one engine cooling passage, wherein the switch is configured to activate the pump in response to the at least one of the pressure and the level of the cooling water being above a threshold pressure or a threshold level, respectively.

3. The cooling system of claim 1, further comprising a battery electrically connected to the pump and configured to power the pump.

4. The cooling system of claim 1, wherein the pump is configured to be coupled to an output shaft of the engine to power the pump.

5. The cooling system of claim 1, further comprising a vent in fluid communication with the at least one engine cooling passage.

6. The cooling system of claim 1, further comprising at least one of an air trap, a riser, and a valve fluidically connected between the pump and the at least one outlet drain.

7. The cooling system of claim 1, wherein the pump is configured to run for a predetermined period of time after being activated in response to the operator command to stop the engine.

8. The cooling system of claim 1, wherein the pump is connected to the at least one engine cooling passage at a low point of the at least one engine cooling passage.

9. The cooling system of claim 1, further comprising at least one conduit providing fluid communication between the at least one engine cooling passage and the pump.

10. A system for draining a cooling system of an inboard marine internal combustion engine, the system comprising:

a pump in fluid communication with the cooling system of the engine, the pump configured to actively draw cooling water out of the cooling system;

a sensor determining at least one of a pressure and a level of the cooling water in the cooling system;

at least one outlet drain downstream of the pump for discharging the cooling water that was pumped out of the cooling system; and a switch configured to activate the pump in response to at least one of the following:

an operator command to stop the engine; and a speed of the engine being below a threshold speed;

wherein the pump is configured to stop drawing cooling water out of the cooling system in response to the at least one of the pressure and the level of the cooling water dropping below a threshold pressure or a threshold level, respectively.

11. The system of claim 10, further comprising a sensor determining a temperature of the cooling water in the cooling system, wherein the switch is configured to activate the pump in response to the temperature of the cooling water being below a threshold temperature.

12. The system of claim 10, further comprising a battery electrically connected to the pump and configured to power the pump.

13. The system of claim 10, wherein the pump is configured to be coupled to an output shaft of the engine to power the pump.

14. The system of claim 10, wherein a vent is provided in fluid communication with the cooling system.

15. The system of claim 10, further comprising at least one of an air trap, a riser, and a valve fluidically connected between the pump and the at least one outlet drain.

16. The system of claim 10, wherein the pump is configured to run for a predetermined period of time after being activated in response to the operator command to stop the engine.

17. The system of claim 10, wherein the threshold speed is an idle speed.

18. The system of claim 10, further comprising a controller in signal communication with the switch and configured to actuate the switch to activate the pump in response to the at least one of the operator command to stop the engine and the speed of the engine being below the threshold speed.

* * * * *